United States Patent [19]

Coffey

[11] Patent Number: 4,743,011

[45] Date of Patent: May 10, 1988

[54] EXERCISE ROWING MACHINE

[76] Inventor: Calvin Coffey, 48 E. Fifth St., Corning, N.Y. 14830

[21] Appl. No.: 882,785

[22] Filed: Jul. 7, 1986

[51] Int. Cl.[4] ..... A63B 21/00

[52] U.S. Cl. ..... 272/72; 272/130

[58] Field of Search ..... 272/72, 73, 130, 132–134, 272/71, 128

[56] References Cited

U.S. PATENT DOCUMENTS

| | | | |
|---|---|---|---|
| 1,111,269 | 9/1914 | Meart | 272/72 |
| 1,979,716 | 11/1934 | Terry | 272/72 |
| 3,473,843 | 12/1967 | Hart | 272/72 |
| 3,528,653 | 9/1970 | Stuckenschneider et al. | 272/72 |
| 3,572,700 | 3/1971 | Mastropaolo | 272/130 |
| 4,047,715 | 9/1977 | Gjessing | 272/72 |
| 4,311,305 | 1/1982 | Lambert et al. | 272/134 X |
| 4,396,188 | 8/1983 | Dreissigacker et al. | 272/72 |
| 4,533,136 | 8/1985 | Smith et al. | 272/73 |
| 4,537,396 | 8/1985 | Hooper | 272/72 |

FOREIGN PATENT DOCUMENTS

| | | | |
|---|---|---|---|
| 1183559 | 3/1985 | Canada | 272/72 |
| 0347533 | 4/1931 | United Kingdom | 272/72 |

*Primary Examiner*—Richard J. Apley
*Assistant Examiner*—S. R. Crow
*Attorney, Agent, or Firm*—Bruns and Wall

[57] ABSTRACT

An exercise rowing machine uses a flywheel as a resistance member and has cam sector arms which are pivoted to rotate with the machine's oars. A bicycle-type chain is pulled to drive a sprocket drive on the flywheel when the oars are stroked. The arcuate shape of the cam sector arms provides a constant resistance force to the stroke of the oars over the oar sweep. The position of the foot stretcher plate is adjustable. A shroud for the flywheel has an adjustable throttle or shutter to control air flow and thus adjust the amount of resistance.

12 Claims, 6 Drawing Sheets

EXERCISE ROWING MACHINE

BACKGROUND OF THE INVENTION

This invention pertains to exercise apparatus, and more particularly to exercise rowing or sculling machines The invention is more specifically directed to a rowing or sculling machine which simulates the sweeping, rowing motion characteristic of a rowing or sculling shell, and which imparts a resistance to the pull of the oars similar to that of an actual rowing or sculling shell.

Typical rowing machines have employed friction brakes or hydraulic resistance devices to simulate the drag resistance met by the oars in water. In these machines, the friction or hydraulic resistance devices are incorporated as part of an oar lock and form the pivot for the simulated oars. Typical rowing machines are illustrated in U.S. Pat. Nos. 3,528,653 and 1,111,269. These rowing machines provided, at best, a crude sensation of rowing, and it was difficult or impossible to set the resistance accurately. The amount of resistance in these machines can change over time, as the device ages. Because it is not possible to control the resistance to the sweep of the oars, and thus cannot program exercise stress for the individual, these rowing machines do not permit optimum use in an exercise training program.

A different approach to a stationary rowing machine was taken in U.S. Pat. No. 4,396,188. With that rowing machine, a flywheel with air vanes translates air movement resistance into resistance to a rowing stroke-like motion. The machine of U.S. Pat. No. 4,396,188 operates by a chain which is pulled to rotate the flywheel. The subject rower sits on a sliding seat and "rows" by pulling on a handle connected to one end of the chain. A one-way clutch allows the chain to be spring-returned without interfering with the flywheel rotation.

While the above device provides accurate and repeatable resistance, it is not possible to use a true sweeping motion, so the sensation is not truly that of rowing or sculling. Moreover, because the hands are kept together on the handle, and are not spread at the beginning and end of each stroke, this machine does not exercise all of the muscle groups that are used in rowing, particularly those of the chest and shoulders.

OBJECTS AND SUMMARY OF THE INVENTION

It is an object of this invention to provide a rowing or sculling exercise machine that surpasses the devices of the prior art in the simulation of rowing or sculling action, and which avoids the drawbacks of the art.

It is a more particular object of this invention to provide a rowing or sculling exercise machine that has a realistic sweeping rowing motion, and that provides an even, consistent resistance to the pull of the oars throughout their sweep.

According to an aspect of this invention, a rowing or sculling exercise machine as provided for a human subject to be seated thereon to simulate rowing or sculling motion. The machine imparts a resistance to the rowing motion similar to the resistance of a boat being rowed or sculled on water. The rowing machine of this invention has a generally horizontal frame, a seat, a track on which the seat slides permitting longitudinal motion of the seat relative to the frame, a foot rest plate or foot stretcher for positioning the subject's feet, and an oar or preferably a pair of oars having respective oar locks mounted laterally of the frame, with the oars being pivotal relative to the associated oar locks to simulate the rowing or sculling motion. Sector arms, or similar cam members, are mounted to rotate with the oars about respective pivot points, and define an arcuate cam surface. A flywheel is journaled on the frame and includes air vanes or equivalent means for imparting a resistance to its rotation. A drive chain assembly has a drive chain and a drive sprocket mounted on the flywheel to rotate the same in one direction. A non-stretching cable is affixed to the cam means cam members to ride over their arcuate surfaces, and is also connected to pull the drive chain. An elastic cord or equivalent resilient return member is connected to the drive chain to return the chain and the cable when the oars are rotated reversely. The oars, the cam members, the cable, the chain, the flywheel, and the return means are arranged so that the human subject pulling on the oars meets a generally even resistance transmitted to the oars from the flywheel, and this even resistance exists throughout the oar stroke. In the preferred embodiment, the flywheel is mounted horizontally beneath the frame, and rearwardly of the subject seated on the machine. Also in the embodiment described herein, the oar locks are arranged to permit rotation of the oars about their own axis at the ends of the oar strokes, to simulate feathering of the oars. Preferably, the cam arrangements are such that their arcuate surfaces are at an equal radius from the pivot points substantially over their operative lengths, so that the resistance to the pull of the oar is substantially constant over the sweep of the oar's stroke.

The above and many other objects, features, and advantages of this invention will be more fully understood from the ensuing detailed description of a preferred embodiment, which should be considered in connection with the accompanying drawing.

DETAILED DESCRIPTION OF A PREFERRED EMBODIMENT

Figure 1:
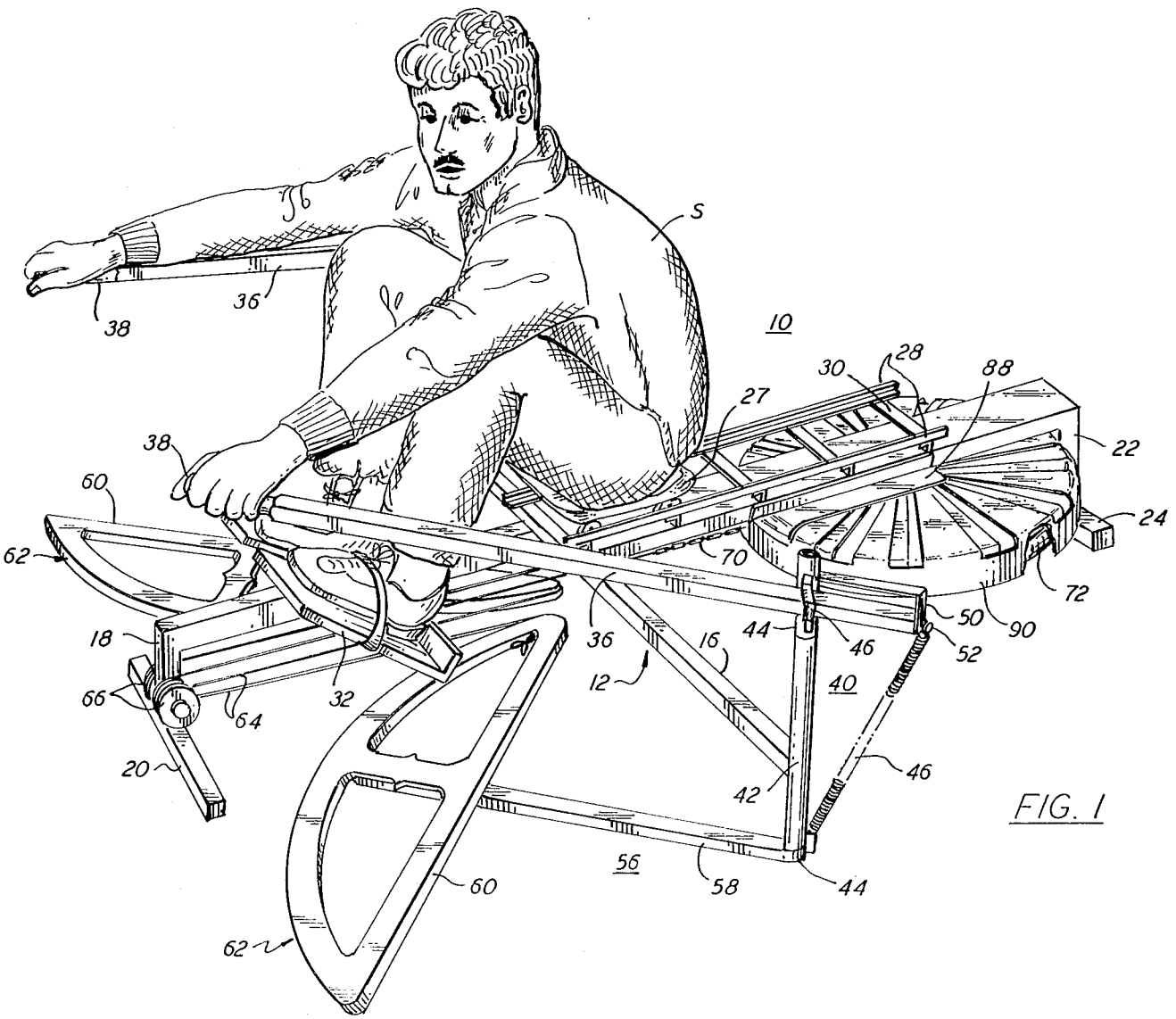
FIG. 1 is a perspective view of an exercise rowing machine according to an embodiment of this invention.
Figure 2:
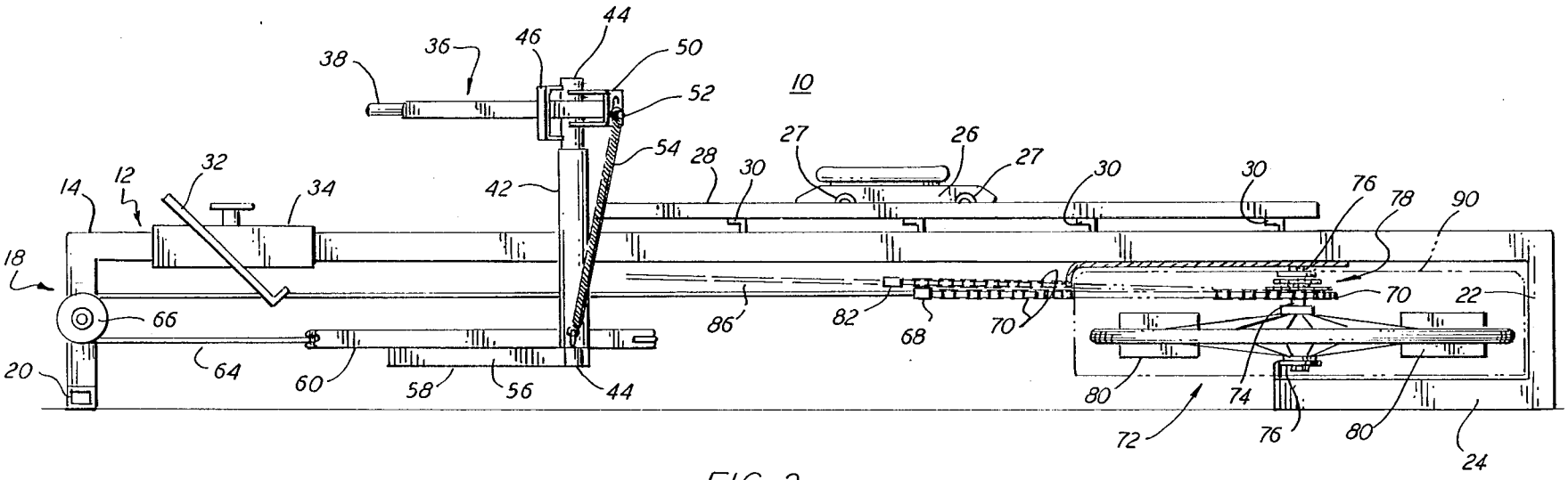
FIG. 2 is a side elevation of the exercise rowing machine according to the embodiment of FIG. 1.
Figure 3:
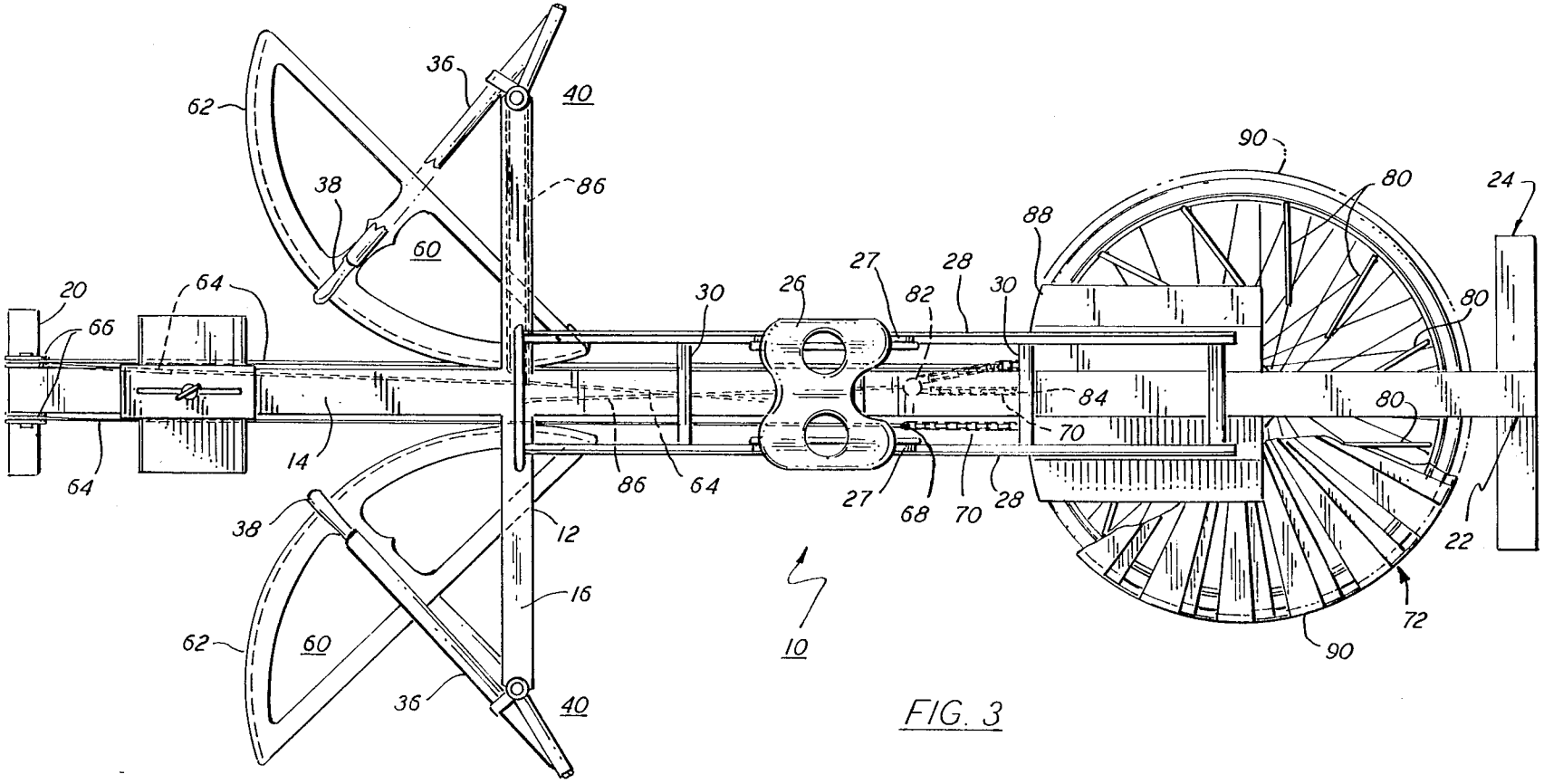
FIG. 3 is a top plan view of the embodiment of FIG. 1.

With reference to the drawing figures, a rowing or sculling machine 10 is illustrated as an example embodying the principles of this invention, and has a generally horizontal frame 12 formed of a longitudinal bar 14 and a cross bar 16 extending transversely thereto. The vertical support leg 18 is affixed to the aft end of the longitudinal bar 14, and has a transverse foot 20 for resting on the floor. Another support leg 22 is affixed to the bar 14 toward the fore end thereof, and has a tee foot 24 in contact with the floor. A seat 26 has rollers 27 which track on rails 28, the latter being attached on supports 30 to the fore portion of the longitudinal frame bar 14. A foot stretcher or foot rest plate 32 is adjustably mounted on the bar 14 by means of an adjustable mount 34, which permits the foot position of a human subject S seated on the set 26 to be adjusted according to the subject's individual physique.

A pair of oars 36 are provided, here, having round cross-sectional shafts and with handles 38 at their free ends Oarlock assemblies 40 are provided at the ends of the crossbar 16, for mounting the oars 36. Each oarlock assembly 40 has a vertical sleeve 42 affixed to the end of the crossbar 16, and a post 44 within the sleeve 42 and rotatable therewith. A square tube retaining frame 46 affixed to the top of the post 44 retains the shaft of the oar 36, the outboard end of frame 46 has a slot 50 which relieves protuberance 52 on the end of the oar 36, the latter traveling upwards and downwards over the length of the slot 50. A spring 54 attached to the protuberance 52 serves as a counterpoise for the oar 36 and is connected to the protuberance 52 and to a lower end of the sleeve 42.

Extending beneath the frame 12 from the lower end of the post 44 is a sector arm 56, here, configured of a constant radius design. The sector arms 56 each have a radial bar 58 that is affixed at one end to rotate with the post 44, the bar 58 bearing a cam member 60, the latter having a grooved circumferential cam surface 62. In this embodiment, the cam members 60 are circularly curved, and the surface 62 is the arc of a circle. However, in alternative embodiments, other curved surfaces could be employed for the surface 62, depending on the desired resistance characteristic for the oars 36.

Figure 5:
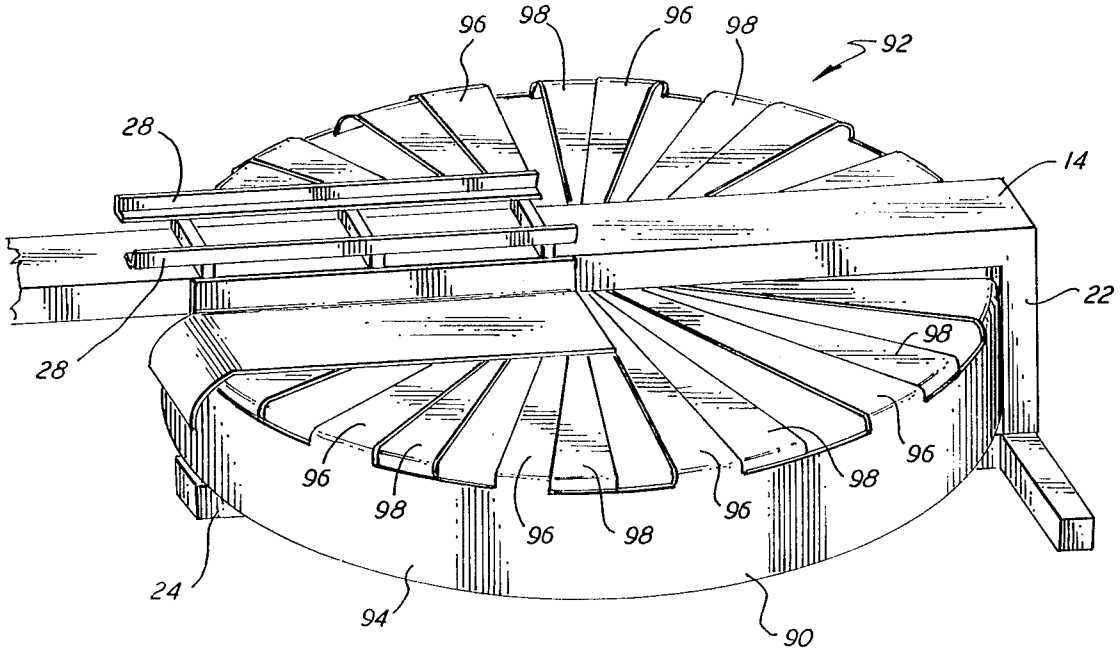
FIG. 5 is a perspective view of a portion of the embodiment of FIG. 1 showing detail of the flywheel shroud.

A cord 64 or equivalent flexible member of a non-stretching material is affixed to each of the cam members 60 and travels over the cam surface 62 thereof. The cord 64 extends over a pulley 66 disposed on the support leg 18, and then forward to a guide pulley 68 beneath the longitudinal bar 14, then aft again to another pulley 66 disposed also at the support leg 18, and from there to the other cam member 60. A bicycle-type drive chain 70 has one end connected to the guide pulley 68, and serves to drive a horizontal flywheel 72 disposed between the tee foot 24 and the fore end of the longitudinal bar 14. The flywheel 72 has a vertical axle 74 which is attached to a pair of mounts 76 disposed respectively on the bar 14 and the foot 24, and has a sprocket 78 on which the chain 70 rides. A plurality of air vanes 80 are disposed about the flywheel 70 and are preferably arranged to pull air from above and discharge beneath. The chain 70 continues over an idler sprocket 82 and then to an anchorage 84 at the fore portion of the bar 14. A shock cord or bungie cord 86, or other resilient similar member is connected at one end to the idler sprocket 82 and provides a return force onto the chain 70. In this embodiment, the cord 86 extends beneath the bar 14 and then out and across underneath the cross bar 16, over several guide rollers (not shown). Also provided are a chain guard 88 at the fore portion of the frame 12 over the chain 70, and a flywheel cage or guard 90 around the flywheel 72. This guard 90 shown only symbolically here, can be arranged as an air guide to deflect air from the vanes 80 in a downwards direction. As shown in FIG. 5, an adjustable throttle or shutter opening 92 on top of guard 90 effectively throttles intake air to alter resistance, thereby changing resistance on the oars 36.

The shroud or guard 90 has a circumferential member 94 directing the air axially downward, and protecting persons in the vicinity from inadvertently coming into contact with the moving flywheel. The shutter or throttle 92 consists of a group of radial fixed plates 96 and movable plates 98, the latter being movable to define the opening size. Of course many other shutter or throttle mechanisms could be employed to control air flow. A control (not shown) permits a rower to adjust the throttle opening.

Figure 6:
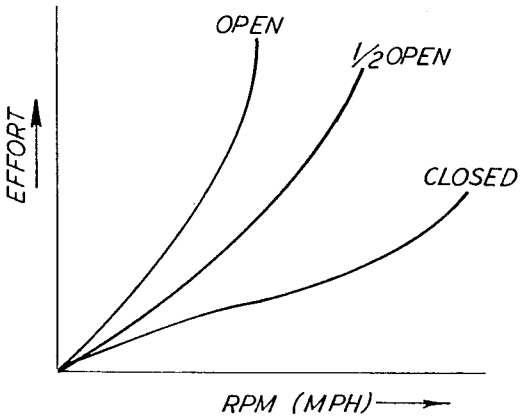
FIGS. 6 and 7 are charts for explaining the operation of the rowing machine of this invention.
Figure 7:
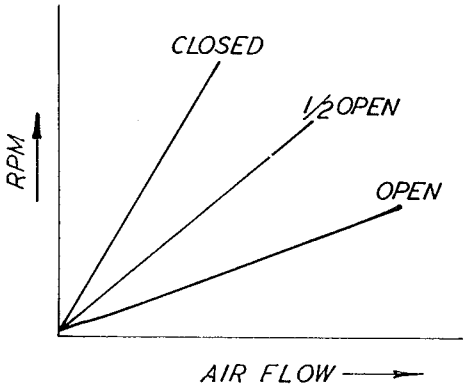
Figure 4:
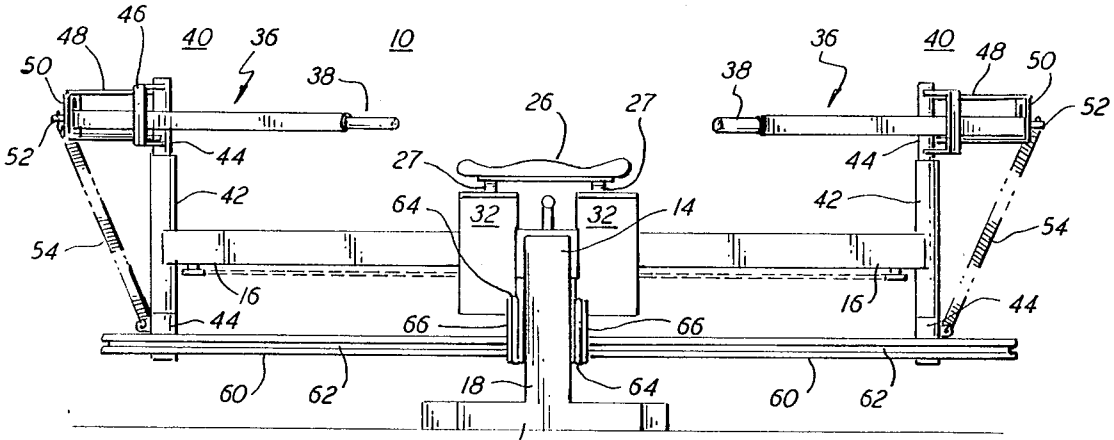
FIG. 4 is a front elevation of the embodiment of FIG. 1.

As shown in FIG. 6, the aerobic effect, i.e. the amount of effort involved in rowing, depends both on the rowing speed and on the degree of opening of the shutter on throttle 92. This is because the effort is related to the air flow speed, and the air flow varies both with the rowing speed (i.e., flywheel speed) and the degree of opening, as indicated in the chart of FIG. 7.

The human subject S is seated on the seat 26, in a fashion as he would be seated in a scull, rowing shell, or boat, that is, facing aft with his or her feet on the foot stretcher 32 and with his or her hands on the oar handles 38. By pulling on the oars 38, the post 44 and cams 60 of the sector arms 56 are rotated, and this pulls the cord 64, which in turn pulls the chain 70 and rotates the flywheel 72. The vanes 80 provide a fairly constant resistance for any given flywheel speed, and provide more resistance for higher speeds. The rowing machine assembly as illustrated simulates true rowing motion, including a reaching motion on the return of the oars. This stretches the muscles of the shoulder and chest, while the sweeping draw or pull of the oars 36 strengthens the muscles of the shoulders and the back.

An alternative version machine 10 can be provided for sweep rowing, i.e., with just the right oar 36 or just the left oar 36 gripping the handle 38 with both hands. The subject S should row for a time on each side so as to exercise evenly.

The oars 36 can be rotated 90 degrees at the ends of the arc of the stroke to simulate feathering of the oars. Still further, the movable foot stretcher 32 adjusts for rowers or subjects of different height who might be using the machine 10, and allows the foot position to be selected relative to the oar pivot points defined by the lock assemblies 40.

Not shown are a sensor for sensing the rotational speed of the flywheel 72 and the number of rotations (equivalent to the distance rowed or sculled). These data together can be fed to an ergometer recorder (also not shown here) to measure the amount of exercise stress to the human subject S.

The principles of this invention could also be employed to a tandem (two-position) rowing machine, to a machine with a friction-type flywheel rather than a vane-type flywheel, or to a machine which uses a belt or cord, rather than a chain, to drive the flywheel.

Another important improvement of the exercise machine 10 of this invention is its horizontal disposition of the flywheel 72 behind the subject S and within the protective shroud 90. This arrangement is significantly more safe to other persons in the exercise area, as well as to the subject S, than previous flywheel-type rowing devices.

Figure 8:
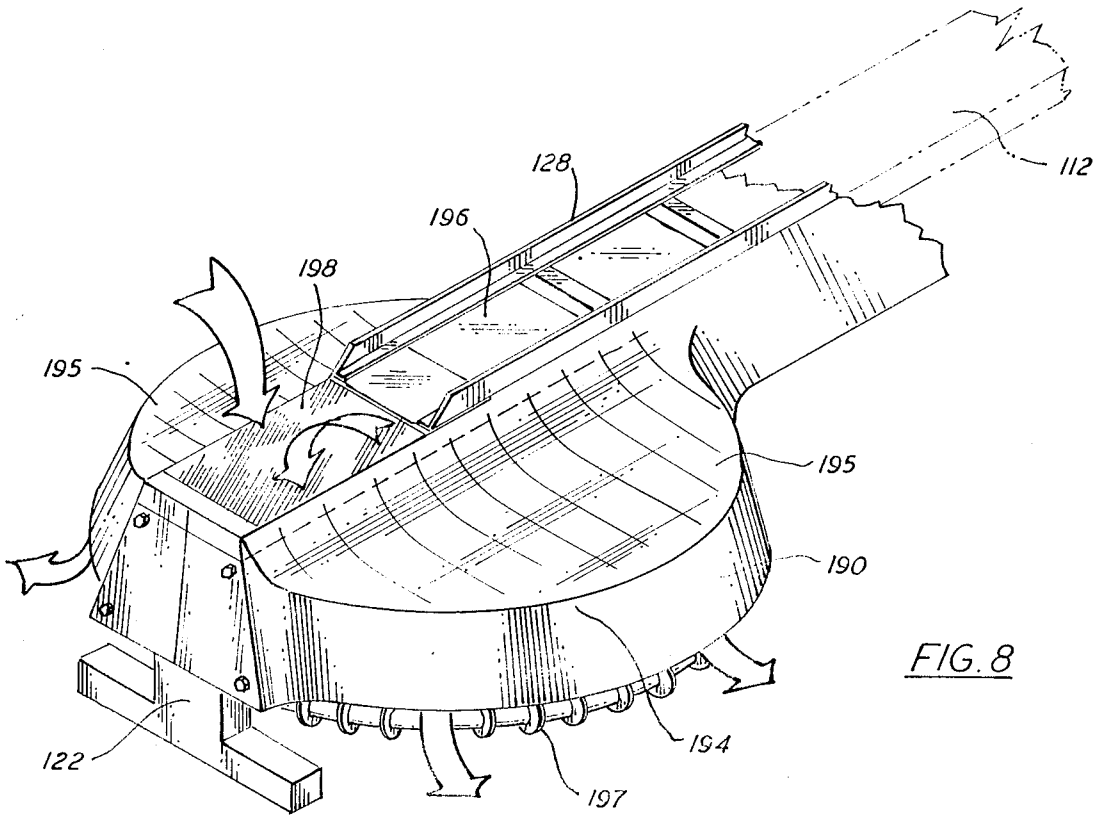
FIG. 8 is a rear quarter partial perspective of another shroud arrangement.

An alternative air shutter arrangement is shown in FIG. 8. There, a shroud 190 has a circumferential member 194 that continues as upper surface 195 over the flywheel (concealed in this view) up to a rectangular, screened air inlet 198, and downwards to a cage 197 or the like, which extends about another two inches beneath the shroud to protect the users fingers and toes from the spinning flywheel and the other moving parts. A sliding air inlet control plate 196 is moved fore-and-aft beneath the seat rails 128 to adjust the opening size of the air inlet 198 and thus control the amount of resistance. The frame 112 and the rear support leg 122 are included in this view to show the orientation of the shroud 190. The flow of air as indicated by the arrows is vertically downward into the inlet 198 and out beneath the flywheel. Additional screened openings can be placed on the upper surface 195 of the shroud 190.

While a particular embodiment has been described herein above, this embodiment was given by way of example, and not for purposes of limitation, and it should be apparent to those skilled in the art that many modifications and variations thereof are possible without departure from the scope and spirit of this invention, as defined in the appended claims.

I claim:

1. A rowing or sculling exercise machine on which a human subject simulates rowing or sculling motion, the machine imparting a resistance to the rowing or sculling motion similar to the resistance of a boat being rowed or sculled on water, the machine comprising a generally horizontal frame, a seat, means mounting said seat on said frame and permitting longitudinal motion relative to said frame for at least a limited distance, foot rest means on said frame for positioning the subject's feet, one or more oars each having respective oarlock means mounted laterally of said frame, said oars being pivotal relative to said oarlock means to simulate said rowing or sculling motion; respective cam means mounted to rotate with said oars about respective pivot points and defining an arcuate cam surface; a flywheel journaled on said frame including means imparting a resistance to rotation thereof; drive chain means including a drive band and a drive member mounted on said flywheel to rotate the same in one direction; a cable affixed to said cam means to ride over the arcuate surface thereof, and connected to one end of said drive band; and resilient return means connected to the other end of said drive band to return said band and said cable when said oars are rotated reversely; the oars, cam means, cable, drive band, flywheel and return means being arranged such that pulling of said oars meets a generally even resistance transmitted thereto from said flywheel through said band, said cable, and said cam means.

2. An exercise machine as in claim 1 wherein said flywheel is horizontally mounted beneath said frame.

3. An exercise machine as in claim 2 wherein said flywheel is mounted rearward of the position of said subject.

4. An exercise machine as in claim 3 wherein said cable runs from said cam means, forward to a pulley mounted on said frame, and then rearward from said pulley to the one end of said drive band.

5. An exercise machine as in claim 4 wherein there are a pair of said oars and oarlock means, and said cable passes from each cam means through a respective pulley back to a chain pulley mounted on said one end of said drive band.

6. An exercise machine as in claim 1 wherein said means imparting resistance to rotation of the flywheel includes a plurality of air vanes on said flywheel.

7. An exercise machine as in claim 1 further comprising adjusting means for setting the position of said foot rest means on said frame.

8. An exercise machine as in claim 1 wherein said frame is generally cross-shaped with said seat traveling along a main bar of the frame and with said oarlock means being mounted at ends of a crossbar of the frame.

9. An exercise machine as in claim 1 wherein said oarlock means each include a standard affixed relative to said frame, a rotating member, and means on said rotating member for holding the oar and permitting travel relative thereto in a limited vertical arc.

10. An exercise machine as in claim 9 wherein said means for holding of said oarlock means includes means permitting rotation of the associated oar, at least at some point of the travel of the oar, to simulate feathering of the oar.

11. An exercise machine as in claim 1 wherein the arcuate surface of each said cam means is at an equal radius from said pivot point substantially over the operative length of the cam surface.

12. An exercise machine as in claim 1 wherein the drive band includes a drive chain and the drive member mounted on the flywheel includes a drive sprocket element.

* * * * *